US006152836A

United States Patent [19]

Bradley et al.

[11] Patent Number: 6,152,836

[45] Date of Patent: Nov. 28, 2000

[54] GOLF BALL WITH A COVER WHICH INCLUDES POLYURETHANE RUBBER

[75] Inventors: Wayne R. Bradley, Dyee; Frank M. Simonutti, Jackson, both of Tenn.

[73] Assignee: Wilson Sporting Goods Co., Chicago, Ill.

[21] Appl. No.: 09/413,947

[22] Filed: Oct. 6, 1999

[51] Int. Cl.[7] ..... A63B 37/12

[52] U.S. Cl. ..... 473/378

[58] Field of Search ..... 473/378, 377, 473/376

[56] References Cited

U.S. PATENT DOCUMENTS

| | | | |
|---|---|---|---|
| 3,034,791 | 5/1962 | Gallagher . | |
| 3,130,102 | 4/1964 | Watson . | |
| 3,177,280 | 4/1965 | Ford et al. . | |
| 3,264,272 | 8/1966 | Rees . | |
| 3,979,126 | 9/1976 | Dusbiber | 473/378 |
| 3,989,568 | 11/1976 | Issac . | |
| 4,068,849 | 1/1978 | DiSalve et al. . | |
| 4,123,061 | 10/1978 | Dusbiber . | |
| 4,234,184 | 11/1980 | Deleens et al. . | |
| 4,248,432 | 2/1981 | Hewitt et al. . | |
| 4,295,652 | 10/1981 | Saito et al. . | |
| 4,442,282 | 4/1984 | Kolycheck | 473/378 |
| 4,674,751 | 6/1987 | Molitor et al. . | |
| 5,006,297 | 4/1991 | Brown et al. . | |
| 5,314,187 | 5/1994 | Proudfit | 473/376 |
| 5,334,673 | 8/1994 | Wu . | |
| 5,688,191 | 11/1997 | Cavallaro et al. . | |
| 5,932,661 | 8/1999 | Simonutti . | |

FOREIGN PATENT DOCUMENTS

| | | |
|---|---|---|
| 0 578 466 A1 | 7/1993 | European Pat. Off. . |

*Primary Examiner*—Jeanette Chapman
*Assistant Examiner*—Raeann Gorden

[57] ABSTRACT

A golf ball includes a cover which includes a blend of polybutadiene and polyurethane rubber. The rubber component of the core consists of 10–90% by weight of polyurethane rubber and 10 to 60% by weight of a high cis content polybutadiene rubber. The cover also includes a crosslinking agent and a crosslinking initiator.

11 Claims, 1 Drawing Sheet

GOLF BALL WITH A COVER WHICH INCLUDES POLYURETHANE RUBBER

BACKGROUND OF THE INVENTION

This invention relates to golf balls, and more particularly, to a golf ball having a cover which includes polyurethane rubber.

Golf balls which are currently available fall into two general categories—balls which include a balata cover and balls which include a more durable, cut-resistant cover. Balata covers are made from natural balata, synthetic balata, or a blend of natural and synthetic balata. Natural rubber or other elastomers may also be included. Synthetic balata is trans polyisoprene and is commonly sold under the designation TP-301 available from Kuraray Isoprene Company Ltd.

Most cut-resistant covers utilize Surlyn ionomers, which are ionic copolymers available from E.I. du Pont de Nemours & Co. Surlyn ionomers are copolymers of olefin, typically ethylene, and an alpha-beta ethylenically unsaturated carboxylic acid, such as methacrylic acid. Neutralization of a number of the acid groups is effected with metal ions, such as sodium, zinc, lithium, and magnesium. DuPont's U.S. Pat. No. 3,264,272 describes procedures for manufacturing ionic copolymers.

Balata covered golf balls have been the preferred golf ball for the better golfer for a number of years, due to the feel properties and control which the better player can impact on the golf ball. However, wound balata balls are expensive and difficult to produce. Balata balls also generally exhibit poor cut resistance, which is also not beneficial.

U.S. Pat. No. 5,314,187 (Proudfit) describes a method for making a balata/polybutadiene golf ball cover, which imparts many of the properties of the balata cover, while being far easier to manufacture.

There are basically three types of solid polyurethanes —castable polyurethanes, thermoplastic polyurethanes, and rubber-like "millable" polyurethanes. Many of the polyurethanes have been tried in golf ball applications, with varying degrees of success.

Castable polyurethanes are made by reacting essentially equimolar amounts of diisocyanates with linear, long chain, non-crystalline polyesters or polyethers. This results in the production of a soft, high molecular weight mass with essentially no crosslinking. To solidify this material, chain extenders such as short chain diols (e.g., 1,4-butane diol) or aromatic diamines (e.g., methylene-bis-orthochloro aniline (MOCA)) are utilzed. This results in creation of linear segments, which are rigid in comparison to the initial mass described above.

Castable polyurethanes have been used in the production of wound golf balls for a number of years, as described in U.S. Pat. No. 4,123,061 and 5,334,673. However, this method production (as described in European Patent Application 0 578 466 A) is time consuming and inefficient.

Thermoplastic polyurethanes are produced through the reaction of bifunctional isocyanates, chain extenders, and long chain polyols. To produce thermoplastic properties, it is necessary for the molecules to be linear. The hardness of the polymer can be adjusted based upon the ratio of hard/soft segments produced in the reaction. Thermoplastic polyurethanes have been evaluated as covers for golf balls, with no significant success. Thermoplastic polyurethanes generally do not have the resilience properties required for a premium sold core golf ball, and the temperature required to melt the thermoplastic polyurethanes make them unsuitable for use as covers on thread wound golf balls. Recently, there has been some success in utilizing thermoplastic polyurethanes as mantle layers in multi-layer golf ball covers.

SUMMARY OF THE INVENTION

The invention provides a golf ball cover consisting of a reaction product of polyurethane rubber (also known as "millable polyurethane"), polybutadiene, and (optionally) balata (trans-polyisoprene). This form of polyurethane is produced by reacting a polyol with a stoichiometric deficiency of isocyanate, which allows the material to be vulcanized, forming crosslinks between the polymer chains. The primary benefit of this form of polyurethane is that it lends itself to processing techniques common to rubber processing.

The compound resulting from the blending of polyurethane rubber, polybutadiene and (optimally) balata (trans-polyisoprene) produces a cover with comparable feel and cut resistance properties to the castable polyurethane covers utilized on the Titleist Professional and Maxfli Revolution golf balls. Also, the covers can be compounded and molded using conventional techniques common to rubber processing. Mixing can be performed in a Banbury type mixer or on a two roll mill, and molding can be performed using compression molding. The invention also yields improved properties (softer feel, comparable initial velocity/coefficient of restitution properties) compared to the balata/polybutadiene blend described in U.S. Pat. No. 5,314,187.

It is highly unlikely that a castable polyurethane would be compatible with polybutadiene, or a polybutadiene/polyisoprene mixture. Thermoplastic polyurethanes would be non-reactive in the blends which are described herein.

DESCRIPTION OF THE DRAWING

The invention will be explained in conjunction with an illustrative embodiment shown in the accompanying drawing, in which.

DESCRIPTION OF SPECIFIC EMBODIMENTS

Figure 1:
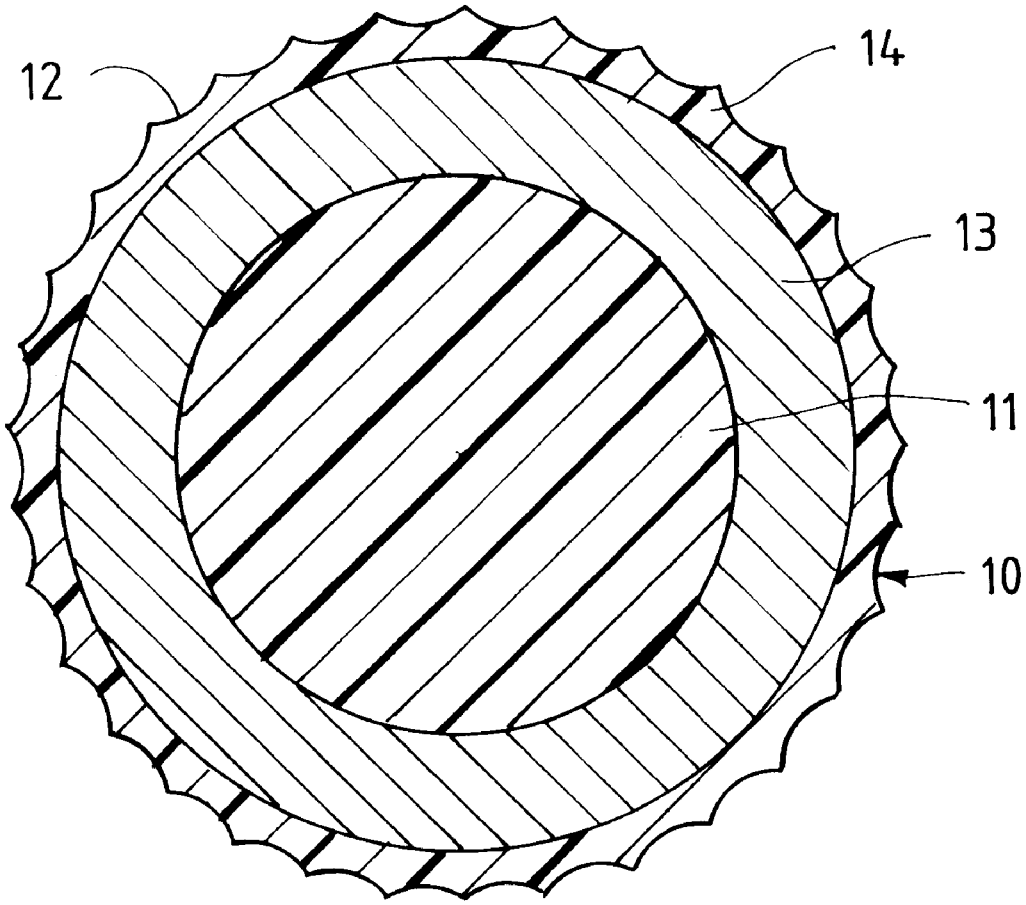
FIG. 1 is a cross sectional illustration of a golf ball which is formed in accordance with the invention.

FIG. 1 illustrates a golf ball 10 which includes a solid core 11 and a cover 12. In the particular embodiment illustrated, the cover 12 includes an inner cover layer or mantle 13 and an outer cover layer 14.

The solid core can be formed from conventional core compounds and can have a diameter within the range of 1.40 to 1.60 inches. In one specific embodiment, the core was formed from a blend of:

100 phr of polybutadiene

~31 phr of zinc diacrylate 5 phr of zinc oxide

~1.1 phr of dicumyl peroxide 0.25 phr of a titanate coupling agent (see U.S. Pat. No. 5,932,661)

inorganic fillers and colorants as required to achieve the desired core weight

The cover consists of a blend of the following:

a) 100 phr rubber consisting of:

i) 10–90% by weight of a ethane rubber (millable polyurethane). The polyurethane rubber can consist of polyether based polyurethane rubber, polyester based polyurethane rubber, or a mixture of the two;

ii) 10–60% by weight of a high cis- content polybutadiene rubber more preferably 30–50% by weight of a high cis-content polybutadhiene rubber;

iii) 0–50% by weight of trans-polyisoprene;

b) 10–40 phr of a crosslinking agent, preferably zinc diacrylate;

c) 0–10 phr of a metal oxide activator, preferably zinc oxide;

d) 0.5–6 phr of a crosslinking initiator, preferably zinc oxide;

e) standard fillers, concentrates, etc.

As used herein "phr" means "parts per hundred parts by weight of rubber."

Materials suitable for use as the polyurethane rubber (millable polyurethane) are available from Uniroyal, under the trade name Adiprene, and from TSE Industries, under the trade name Millithane.

The mantle 13 is optional. If a mantle layer(s) is utilized, materials suitable for use as the mantle include: Surlyn, thermoplastic polyurethanes, thermoset polyurethanes, polyester elastomers, polyether block amide co-polymers, or blends thereof. If utilized, the mantle layer should have a thickness of 0.020–0.100 inch.

In one specific embodiment, the mantle comprised 50% by weight of a high acid ionomer, consisting of 19% methacrylic acid and the remainder ethylene, neutralized with sodium ions, and 50% by weight of a high acid ionomer, consisting of 19% methacrylic acid and the remainder ethylene, neutralized with Mg ions. The resultant blend had a flexural modulus of about 70,000 psi, and a shore "D" hardness of about 71.

A preferred construction of the ball is as follows:

a) a solid core, having a diameter of about 1.520 inches;

b) a mantle layer, consisting of a Surlyn blend, having a Shore D hardness of greater than 68, and a thickness of 0.025–0.035 inch, and c) an outer cover layer consisting of a rubber blend of:

i) about 40% by weight of polybutadiene;

ii) 10–60% by weight of a polyurethane rubber rubber (millable polyurethane), preferably a polyether based polyurethane, and iii) 0–50% by weight of trans-polyisoprene.

The diameter of the golf ball was about 1.680 inches.

EXAMPLES

Golf ball covers were made in accordance with Table 1. The amount of each component is expressed in phr.

The control example is the current compound utilized in the Wilson Staff Batala golf ball, and is described in U.S. Pat. No. 5,314,187.

Example 1 is a formulation of the invention, comprising polybutadiene (40%), trans-polyisoprene (50%), and a polyurethane rubber (10%).

Example 2 is a formulation of the invention, comprising polybutadiene (40%), trans-polyisoprene (40%), and polyurethane rubber (20%).

Example 3 is a formulation of the invention, comprising polybutadiene (40%) and polyurethane rubber (60%).

TABLE 1

| Polyurethane Rubber Compound Cover Evaluations | | | | |
|---|---|---|---|---|
| Material | Cont | 1 | 2 | 3 |
| BR 1207 | 40 | 40 | 40 | 40 |
| Millithane E-34 | 0 | 10 | 20 | 60 |
| TP301 | 60 | 50 | 40 | 0 |
| SR 416D | 34.64 | 34.64 | 34.64 | 34.64 |
| Zinc Oxide | 3.3 | 3.3 | 3.3 | 3.3 |
| Titanium Dioxide | 17.15 | 17.15 | 17.15 | 17.15 |
| Varox 230XL | 3.32 | 3.32 | 3.32 | 3.32 |
| Wingstay L-HLS | 0.2 | 0.2 | 0.2 | 0.2 |

BR 1207-Goodyear Polybutadiene (97% cis content)
Millithane E-34-TSE Industries Polyether Polyurethane Rubber
TP-301-trans-polyisoprene-Kuraray
SR 416D-Sartomer Zinc Diacrylate
Varox 230XL-Butyl 4,4-di (tert-butylperoxy) valerate, 40% active peroxide
Wingstay L-HLS-Goodyear Antioxidant Table 2 illustrates a comparison of the physical properties of the balls of the invention. The balls utilizing covers of the invention are compared to the current Wilson Staff Balata ball and competitive balls comprising covers of polyurethane (Titleist Professional, Maxfli Revolution) or balata (Maxfli HT).

TABLE 2

| Ball Physical Properties | | | | | | |
|---|---|---|---|---|---|---|
| | PGA | | C.O.R. | | | |
| Cover Compound | Compression | Shore D | 125 ft/s | 150 ft/s | 175 ft/s | Initial Velocity |
| Control | 93.2 | 57 | 0.802 | 0.771 | 0.734 | 256.6 |
| Example 1 | 95.2 | 56 | 0.798 | 0.768 | 0.736 | 256.2 |
| Example 2 | 93.2 | 54 | 0.800 | 0.767 | 0.735 | 256.1 |
| Example 3 | 90.3 | 52 | 0.794 | 0.765 | 0.729 | 254.9 |
| Maxfli Revolution | 86.7 | 58 | 0.798 | 0.775 | 0.751 | 257.4 |
| Maxfli HT | 80.5 | 52 | 0.775 | 0.762 | 0.745 | 253.3 |
| Titleist Professional | 89.8 | 56 | 0.776 | 0.767 | 0.745 | 254.0 |

PGA Compression-Measured using Atti Compression machine
Shore 'D' Hardness-Measured according to ASTM D-2240
COR (100 ft/s)-Ratio of outbound velocity/inbound velocity-100 ft/s inbound velocity test setup
COR (125 ft/s)-Ratio of outbound velocity/inbound velocity-125 ft/s inbound velocity test setup
COR (150 ft/s)-Ratio of outbound velocity/inbound velocity-150 ft/s inbound velocity test setup
COR (175 ft/s)-Ratio of outbound velocity/inbound velocity-175 ft/s inbound velocity test setup The ball of Example 1 (utilizing 10% polyurethane rubber in the cover) yielded a decrease in cover hardness with comparable resilience properties compared to the Staff Balata control. The ball of Example 1 yielded a comparable cover hardness compared to all competitive products and significantly higher resilience properties than the Maxfli HT or Titleist Professional golf balls.

The ball of Example 2 (utilizing 20% polyurethane rubber in the cover) yielded a significant decrease in cover hardness with comparable resilience properties compared to the Staff Balata control. The ball of Example 2 yielded a softer cover than the Maxfli Revolution and Titleist Professional (comparable to Maxfli HT), and comparable or higher resilience properties than all of the competitive products.

The ball of Example 3 (utilizing 60% polyurethane rubber in the cover) yielded a significant decrease in cover hardness with comparable resilience properties to the Staff Balata control. The ball of Example 3 yielded a softer cover than the Maxfli Revolution and Titleist Professional (comparable to Maxfli HT), and comparable or higher resilience properties than all of the competitive products.

Table 3 illustrates a comparison of the flight and spin characteristics of the balls of the invention. The balls utilizing covers of the invention are compared to the current Staff Balata ball and to competitive balls comprising covers of polyurethane (Titleist Professional Maxfli Revolution) and balata (Maxfli HT).

TABLE 3

Ball Flight Properties

| Cover Compound/Ball | Carry | Driver | Apogee | Spin | I.V. | 9-Iron |
|---|---|---|---|---|---|---|
| Control | 225.8 | 230.9 | 11.2 | 3282 | 223.9 | 7221 |
| Example 1 | 226.6 | 230.1 | 11.1 | 3472 | 224.1 | 7427 |
| Example 2 | 226.1 | 232.0 | 11.1 | 3425 | 223.7 | 7429 |
| Example 3 | 225.7 | 230.5 | 11.2 | 3434 | 223.2 | 7500 |
| Maxfli Revolution | 226.6 | 229.0 | 11.6 | 3605 | 224.6 | 7634 |
| Maxfli HT | 222.0 | 226.0 | 11.2 | 3701 | 221.4 | 6842 |
| Titleist Professional | 224.7 | 231.2 | 11.2 | 3758 | 223.2 | 7127 |

Driver results measured using True Temper machine:
Driver club-9.0 degree loft
Launch Angle-9.5 degrees
Clubhead velocity-150 ft/s
9-Iron Spin rate measured using True Temper machine:
9-Iron club-48 degree loft
Launch Angle-24 degrees
Clubhead velocity-105 ft/s The ball of Example 1 yielded comparable flight distance and ball velocity to the current Staff Balata, and an increase in spin rate, off of both driver and 9-Iron clubs. Compared to competitive products the ball of Example 1 yielded comparable flight distance to the Titleist Professional and longer flight distance than the Maxfli Revolution and HT. The ball of Example 1 yielded a lower spin rate off of driver than all competitive balls, a higher spin rate off 9-Iron than Maxfli HT and Titleist Professional, and a comparable spin rate to Maxfli Revolution.

The ball of Example 2 yielded comparable flight distance and ball velocity to the current Staff Balata, and an increase in spin rate, off of both driver and 9-Iron clubs. Compared to competitive products, the ball of Example 2 yielded comparable flight distance to the Titleist Professional and longer flight distance than the Maxfli Revolution and HT. The ball of Example 2 yielded a lower spin rate off of driver than all competitive balls, a higher spin rate off 9-Iron than Maxfli HT and Titleist Professional, and a comparable spin rate to Maxfli Revolution.

The ball of Example 3 yielded comparable flight distance and ball velocity to the current Staff Balata, and an increase in spin rate, off of both driver and 9-Iron clubs. Compared to competitive product, the ball of Example 3 yielded comparable flight distance to the Titleist Professional and longer flight distance than the Maxfli Revolution and HT. The ball of Example 3 yielded a lower spin rate off of driver than all competitive balls, a higher spin rate off 9-Iron than Maxfli HT and Titleist Professional, and a comparable spin rate to Maxfli Revolution.

Overall, the balls made using polyurethane rubber (millable polyurethane) result in comparable flight properties with softer cover (Shore D) and improved spin rate (9-Iron) compared to previous the Staff Balata ball.

Also, the balls made using covers comprising polyurethane rubber (millable polyurethane) result in comparable or improved cover hardness, flight properties, and spin rates compared to polyurethane and balata covered wound golf balls currently on the market (Maxfli Revolution, Maxfli HT, Titleist Professional).

While in the foregoing specification a detailed description of specific embodiments of the invention was set forth for the purpose of illustration, it will be understood that many of the details herein given can be varied considerably by those skilled in the art without departing from the spirit and scope of the invention.

We claim:

1. A golf ball comprising a core and a cover, the cover comprising:

100 phr rubber, the rubber consisting of 10 to 90% by weight of a polyurethane rubber, 10 to 60% by weight of a high cis content polybutadiene rubber, and 0 to 50% by weight of trans-polyisoprene, 10 to 40 phr of a crosslinking agent, 0.5 to 6 phr of a crosslinking initiator, and 0 to 10 phr of a metal oxide activator.

2. The golf ball of claim 1 in which the polyurethane rubber is a polyester based polyurethane rubber.

3. The golf ball of claim 1 in which the polyurethane rubber is a mixture of polyester and polyester based polyurethane rubber.

4. The golf ball of claim 1 in which the crosslinking agent is an acrylate of a metal salt.

5. The golf ball of claim 4 in which the acrylate of a metal salt is zinc diacrylate.

6. The golf ball of claim 1 in which the crosslinking initiator is an organic peroxide.

7. The golf ball of claim 1 in which the metal oxide activator is zinc oxide.

8. The golf ball of claim 1 in which the cover includes 40 to 50% by weight of trans-polyisoprene.

9. The golf ball of claim 8 in which the cover includes 10 to 20% by weight of polyurethane rubber.

10. The golf ball of claim 9 in which the cover includes 40% by weight of high cis content polybutadiene rubber.

11. The golf ball of claim 1 in which the cover includes 30 to 50% by weight of high cis content polybutadiene rubber.

* * * * *